US008830076B2

(12) United States Patent
Smith et al.

(10) Patent No.: US 8,830,076 B2
(45) Date of Patent: Sep. 9, 2014

(54) CONTAINER HAVING A USE-EVIDENT DEVICE

(71) Applicant: Owens-Brockway Glass Container Inc., Perrysburg, OH (US)

(72) Inventors: Roger P. Smith, Perrysburg, OH (US); Brad Malcolm, Ivanhoe (AU); Chris Anderson, Perrysburg, OH (US); Phyllis A. Cresswell, Perrysburg, OH (US); Oleg Feygenson, Saint Petersburg (RU); Anatoly Solunin, Saint Petersburg (RU); Igoris Misiucenko, Saint Petersburg (RU)

(73) Assignee: Owens-Brockway Glass Container Inc., Perrysburg, OH (US)

( * ) Notice: Subject to any disclaimer, the term of this patent is extended or adjusted under 35 U.S.C. 154(b) by 70 days.

(21) Appl. No.: 13/683,475

(22) Filed: Nov. 21, 2012

(65) Prior Publication Data

US 2014/0138276 A1 May 22, 2014

(51) Int. Cl.
*G08B 21/00* (2006.01)

(52) U.S. Cl.
USPC ..... 340/669; 340/686.1

(58) Field of Classification Search
USPC ..... 340/505, 568.1, 571, 572.1, 309.4, 340/309.7, 309.8, 309.16, 669; 368/10; 235/375; 219/413, 428; 362/154
See application file for complete search history.

(56) References Cited

U.S. PATENT DOCUMENTS

| | | | | |
|---|---|---|---|---|
| 3,399,811 | A | 9/1968 | Miller | |
| 6,226,619 | B1 | 5/2001 | Halperin et al. | |
| 6,529,446 | B1 * | 3/2003 | de la Huerga | 368/10 |
| 7,017,807 | B2 | 3/2006 | Kipp et al. | |
| 7,202,780 | B2 | 4/2007 | Teller | |
| 7,276,675 | B2 * | 10/2007 | Faries et al. | 219/413 |
| 7,307,245 | B2 * | 12/2007 | Faries et al. | 219/413 |
| 7,417,205 | B2 * | 8/2008 | Faries et al. | 219/428 |
| 7,898,422 | B2 | 3/2011 | Puccini | |
| 7,916,034 | B1 | 3/2011 | Puccini | |
| 7,973,664 | B1 | 7/2011 | Lambert et al. | |
| 8,040,244 | B2 | 10/2011 | Bauchot et al. | |
| 8,672,504 | B2 * | 3/2014 | Kramer | 362/154 |
| 2013/0002429 | A1 * | 1/2013 | Johnson | 340/568.1 |

FOREIGN PATENT DOCUMENTS

| | | | |
|---|---|---|---|
| KR | 200410362 | Y1 | 3/2006 |
| WO | 2004110892 | | 12/2004 |
| WO | 2006064523 | | 6/2006 |
| WO | 2006123983 | | 11/2006 |
| WO | 2009116804 | | 9/2009 |
| WO | 2011092461 | | 8/2011 |

OTHER PUBLICATIONS

PCT International Search Report and Written Opinion, Int Serial No. PCT/US2013/065454, Int Filing Date: Oct. 17, 2013, Applicant: Owens-Brockway Glass Container Inc., Mail Date: Feb. 10, 2014.

* cited by examiner

*Primary Examiner* — Van T. Trieu

(57) ABSTRACT

A product includes an indicator at least a portion of which is carried by a container and responsive to a change in at least one state of the container to irreversibly modify a visual characteristic visible from outside the container.

33 Claims, 6 Drawing Sheets

CONTAINER HAVING A USE-EVIDENT DEVICE

The present disclosure is directed to containers and, more particularly, to containers having anti-counterfeit and/or tamper-evident features.

BACKGROUND AND SUMMARY OF THE DISCLOSURE

Many containers are provided with tamper-resistant devices to resist refilling of contents in the containers. For example, a beverage container can include a fitment that renders the container non-refillable, so as to impede efforts to refill the container with inferior products. U.S. Pat. No. 3,399,811 illustrates a container of this type.

A general object of the present disclosure, in accordance with one aspect of the disclosure, is to provide a product including a container and a use indicator carried by the container that indicates whether the container has been used and, thus, will provide evidence of efforts to repackage the container with counterfeit product.

The present disclosure embodies a number of aspects that can be implemented separately from or in combination with each other.

A package in accordance with one aspect of the disclosure includes a container having an open end, a closure closing the open end of the container, and a sensor carried by at least one of the container or the closure to detect at least one of pressure in the container or weight of product in the container.

In accordance with a further aspect of the disclosure, there is provided a product that includes a container, and an indicator carried by the container, and responsive to a change in at least one state of the container to irreversibly modify a visual characteristic visible from outside the container.

In accordance with another aspect of the disclosure, there is provided a method of producing a package that includes (a) coupling at least a portion of an indicator to a container, wherein the indicator includes a sensor and a display; (b) filling the container with an original flop/able product; and (c) closing the container with a closure. After at least one of the filling or closing steps, the display exhibits an initial state of a visual characteristic of a plurality of states of the visual characteristic.

BRIEF DESCRIPTION OF THE DRAWINGS

The disclosure, together with additional objects, features, advantages and aspects thereof, will be best understood from the following description, the appended claims and the accompanying drawings, in which:

DETAILED DESCRIPTION OF PREFERRED EMBODIMENTS

Figure 1:
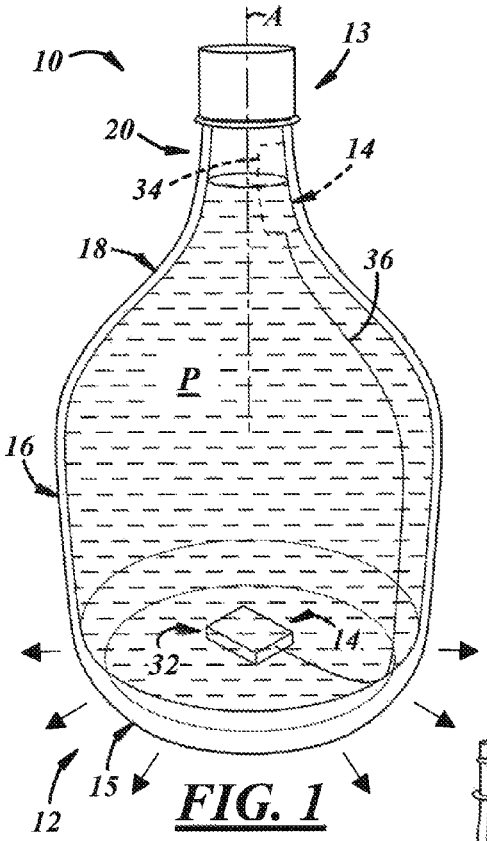
FIG. 1 is a perspective view of a package in accordance with an illustrative embodiment of the present disclosure and including a container filled with a product, and a use indicator carried by the container and shown in an inactivated state responsive to an original or initial weight of the product.

FIG. 1 illustrates a package 10 in accordance with an illustrative embodiment of the disclosure as including a container 12, a closure 13 for the container 12, an authentic or original material or product P filling the container 12, and an indicator 14 carried by the container 12. As will be described in further detail below, the indicator 14 may facilitate evidencing of efforts to tamper with the package 10, by being responsive to a change in a state of the container 12 to irreversibly change or modify an optical or visual characteristic visible from outside the container 12. The change in state of the container 12 may include opening of the container 12 and/or dispensing of product out of the container 12.

The indicator 14 may provide a counterfeit deterrence feature that provides evidence that an original package has been used. More specifically, the indicator 14 may indicate design-intent use of the container 12, like container opening and/or product dispensing, such that a purchaser can see that the container 12 has been "used" after the container 12 was originally packaged with the product P carried therein and the closure 13 coupled thereto. For example, the package 10 may be sealed by a beverage manufacturer, delivered to a customer, opened, and then partially or completely emptied of its original flowable product P. Thereafter, if counterfeiters attempt to refill the emptied container 12 with counterfeit product and repackage the package 10 with the closure 13 (with or without closure seals or the like), the refilled and repackaged package 10 will include the state modified indicator 14 as evidence that the package 10 is not original and, instead, has been refilled and repackaged. In other words, the container 12 or package 10 are permanently or irreversibly tagged as being a once-fillable container or package. Over time, purchasers will become educated to spot refilled counterfeit packages. Thus, counterfeiters will be deterred from offering counterfeit packages to such educated purchasers.

The container 12 may be of one-piece integrally formed construction, for example, metal, glass, ceramic, or plastic construction. (The term "integrally formed construction" does not exclude one-piece integrally molded layered glass constructions of the type disclosed for example in U.S. Pat. No. 4,740,401, or one-piece glass bottles to which other structure is added after the bottle-forming operation.) The container 12 may be fabricated in press-and-blow or blow-and-blow glass container manufacturing operations, or in a plastic injection and/or blow molding operation, or in any other suitable manner.

The container 12 may be of any suitable shape, and may include a jug, jar, bottle, other food or beverage container, or any other suitable container. The container 12 may include a base 15 on which the container 12 may be supported, a body 16 extending axially from the base 15, a shoulder 18 extending radially and axially from the body 16, and a neck 20 extending axially from the shoulder 18. As used herein, the term axial includes oriented generally along a longitudinal axis of the closure, container, or package and may include but is not limited to a direction that is strictly parallel to a container longitudinal central axis A. The body 16 and the neck 20 may be generally cylindrical, as illustrated, or they may be tapered or of any other suitable shape.

Figure 2:
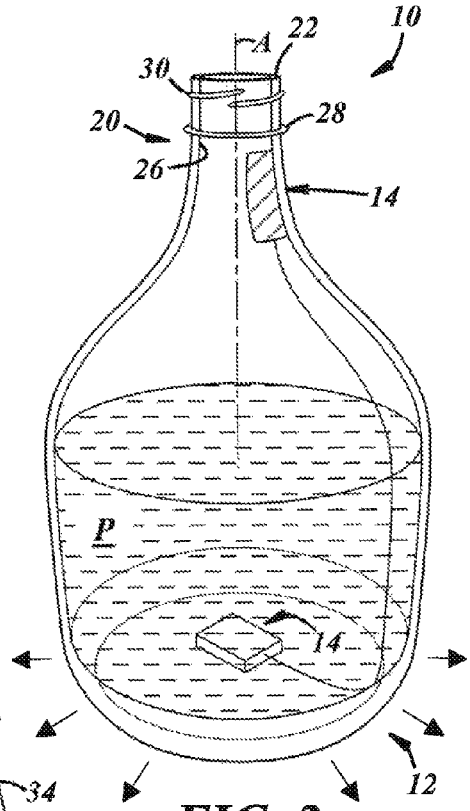
FIG. 2 is a perspective view of a product including the container of FIG. 1 relieved of some of the product of FIG. 1, and with the use indicator of FIG. 1 shown in a partially activated state responsive to reduced weight of the product.

With reference to FIG. 2, the neck 20 may include a lip or axial outward end surface 22, and an interior surface 26. The neck 20 also may include a finish, which may include a capping flange 28, and one or more threads or thread segments 30, or the like for coupling to the closure 13 (FIG. 1).

The product P may be dispensably disposed within the container 12 of the package 10. For example, a product manufacturer may fill the container 12 with the authentic or original flowable product P at a packaging plant and close the container 12 with the closure 13, which may be fastened to the neck 20 of the container 12 in any suitable manner and may be sealed thereto with wax, paper or plastic seal, or any other suitable seal (none shown). Thereafter, the closure 13 may be removed and the product P dispensed out of the container 12 through the neck 20. The closure 13 may include a cap, cork, plug, or any other suitable type of closure. The product P may include a liquid or solid, for example, a beverage, for instance, beer, wine, liquor, soda, or any other suitable beverage or liquid, or a food of any kind.

With reference to FIG. 1, the indicator 14 may include any suitable components and may be carried in any suitable location(s) of the container 12, internally and/or externally of the container 12. One or more portions of the indicator 14 may be non-removably secured to the container 12, or carried by the container 12 in any other suitable manner. The terminology "non-removably secured" includes a manner in which the indicator 14 is, by design-intent, not intended to be removed from the container 12 without damaging the container 12 and/or indicator 14 or otherwise visibly compromising the structural and/or functional integrity of either or both.

The indicator 14 is responsive to a change in the container 12. For example, the indicator 14 may be responsive to a change in pressure in the container 12 as a result of opening of the package 10, for example via partial or complete removal of the closure 13 from the container 12. In another example, the indicator 14 also or instead may be responsive to a change in weight of the original flowable product P in the container 12 as a result of dispensing of the product P from the container 12 after the package 10 has been opened. The indicator 14 may include a sensor 32 that may be carried by the container 12, and a display 34 carried by the container 12 and electrically coupled to the sensor 32. The sensor 32 and the display 34 may be directly coupled to one another but, in the illustrated embodiment, the indicator 14 also may include an electrical conductor 36 that may be carried by the container 12, for example, for electrically coupling the sensor 32 and the display 34 together.

The sensor 32 may be carried by the container 12 in any suitable manner to detect one or more forces acting on the container 12. The weight of the product P imposes a force on the container 12 such that the container 12 may flex (albeit imperceptibly to the eye) such that mechanical stresses in the body 16 and/or base 15 of the container 12 may be measured. The sensor 32 may include one or more piezoelectric sensors to detect forces and/or changes in forces imposed on the container 12, for instance, via sensed stress and/or change in stresses in one or more walls of the container 12. Accordingly, the sensor 32 may output voltage and/or changes in voltages in response (proportional or otherwise) to the forces, stresses, and changes therein. The sensor 32 may be carried by the base 15 of the container 12. More specifically, the sensor 32 may be coupled to an interior surface or an exterior surface of a wall of the base 15, for instance, by being adhered to the base wall, placed in or snap fit to a corresponding debossment or depression in the base wall, or coupled in any other suitable manner thereto. The sensor 32 and a surrounding portion of the container 12 may be covered by an epoxy layer, a silicon layer, a screen printed layer, or the like. In other embodiments, the sensor 32 may be carried by other portions of the container 12, for instance, the body 16 or the shoulder 18 in a similar manner.

The conductor 36 may include a wire, a trace, and/or the like, and may be carried by the container 12 in any suitable manner to electrically couple the display 34 to the sensor 32. For example, the conductor 36 may be carried by corresponding walls of the base 15 and body 16. More specifically, the conductor 36 may be adhered to the walls, molded into and/or through the walls, fit in corresponding channels in the walls, printed to the walls, or coupled thereto in any other suitable manner.

The display 34 may be carried by the container 12 in any suitable manner and electrically coupled to the sensor 32, for instance, via the conductor 36, to receive voltage therefrom that may be used by the display 34 to modify an optical or visual appearance or characteristic associated with the product or package including the container 12 and/or the indicator 14. The characteristic may include opacity or transparency, color, or any other characteristic visible to the eye. The display 34 may include one or more electrochromic (or electrochromatic) devices, which may include electrically switchable or variable glass or glazing that has switchable or variable light transmission properties depending on voltage applied thereto. For example, in one or more embodiments, the electrochromic device may include "Smart Glass," "EGlass," "smart sunglass," or "smart window" light transmission technology. The electrochromic device may include electrochromic polymers, and any other suitable materials. In other embodiments, the display 34 may include a liquid crystal display (LCD), or the like.

Accordingly, in one example, the display 34 may be activated or deactivated to selectively modify transparency of at least a portion of the indicator 14 or container 12. The illustrated display 34 is of generally rectangular shape for selective coverage of the container 12, but may be of any other suitable shape, size, or configuration. The display 34 may be coupled to an interior surface or an exterior surface of a wall of the neck 20, for instance, by being adhered to the neck wall, placed in or snap fit to a corresponding debossment or depression in the neck wall, or coupled in any other suitable manner thereto. The display 34 and a surrounding portion of the container 12 may be covered by an epoxy layer, a silicon layer, a screen printed layer, or the like. In other embodiments, the sensor 34 may be carried by other portions of the container 12, for instance, the shoulder 18, the body 16, or the base 15 in a similar manner.

Prior to filling of the container 12 with the product P, the display 34 may be in a default state. For example, the container 12 may be empty and the display 34 may be opaque. As the product P is introduced into the container 12, the sensor 32 detects the increasing weight of the product P and outputs an increasing voltage to the display 34 to modify the transparency or opacity of the display 34 to become transparent. As illustrated in FIG. 1, the display 34 is shown in a neutral or inactivated state, which, in the illustrated example embodiment is transparent.

But, with reference to FIG. 2, upon initial opening of the package 10 and/or upon dispensing of the original flowable product P, the indicator 14 is adapted irreversibly to modify a state of a visual characteristic visible from outside of the container 12 to advise a user that the authentic product P has been dispensed from the container 12. Accordingly, the indicator 14 will exhibit a second state of the visual characteristic that is different from the first state of the visual characteristic. The terminology "irreversible" includes a manner in which the indicator 14 is, by design-intent, modifiable in one direction, for example, transparent to opaque and not back to transparent, or in another example, opaque to transparent and not back to opaque. Activation and deactivation of the indicator 14 makes it possible to modify a characteristic, like transparency of the indicator 14 and/or container 12.

For example, the display 34 of the indicator 14 is illustrated in FIG. 2 in a state different from that shown in FIG. 1. More specifically, the display 34 is shown in a partially deactivated state, which corresponds to a partially emptied state of the container 12. In particular, the display 34 may exhibit modified or different opacity or transparency as a result of at least some of the product P having been dispensed from the container 12. The reduced amount of the product P results in a reduced force imposed by the product P on the container 12, and a concomitant change in stress in the container 12, for instance, in the container wall(s). Accordingly, the sensor 32 outputs a different voltage level to the display 34, which, in turn, irreversibly modifies the visual characteristic to the different state, for instance, to a partially opaque or partially transparent state.

In one embodiment, the sensor 32 or the display 34 may include an integrated latch-type electrical circuit or a fusible link to proven voltage from passing from the sensor 32 to the display 34 ever again, thus preventing the transparency of the display 34 from ever again changing. In another embodiment, a microcontroller (not separately shown) with embedded code may be integrated with or coupled to the sensor 32. The microcontroller would function so that once the voltage output from the sensor 32 to the display 34 changed (increased or decreased, depending on the specific configuration desired) the microcontroller would never again allow the voltage output to revert or return to any previous output level. For example, if the sensor 32 initially outputs zero voltage to the display 34 when the container 12 is full, as the container 12 is emptied, the weight of the product therein would change, thereby causing an increase in the voltage output from the sensor 32 to the display 34. This increase in voltage would cause a change in transparency of the display 34, but if the container 12 is then refilled, even after only being half empty, the coded microcontroller would function to prevent the voltage output to return to zero. Instead, in response to the increase in weight from refilling, after the decrease in weight from dispensing, the microcontroller could function to output even more voltage to the display 34 to completely change the transparency of the display 34, permanently or irreversibly.

Figure 3:
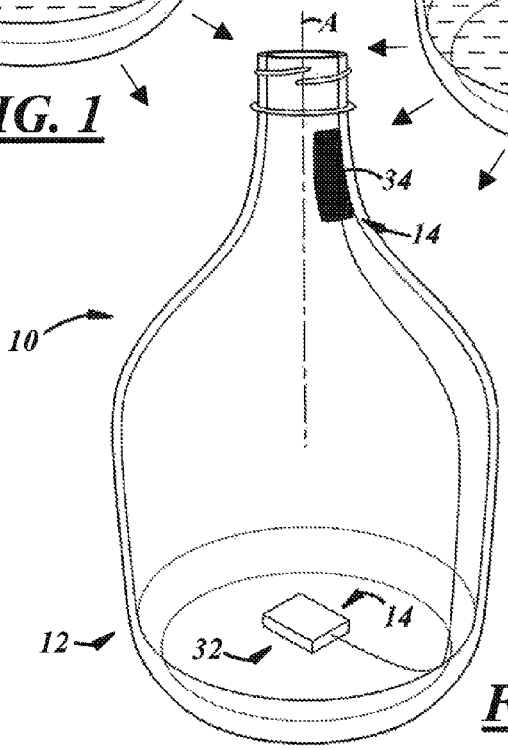
FIG. 3 is a perspective view of the product of FIG. 2, wherein the container is empty, and the use indicator is shown in an activated state responsive to absence of the product.

In another example, and referring to FIG. 3, the display 34 of the indicator 14 is illustrated in another state different from that shown in FIGS. 1 and 2. More specifically, the display 34 is shown in a deactivated state, which corresponds to a fully emptied state of the container 12. In response to the weight change, the sensor 32 outputs a different voltage level to the display 34, which, in turn, irreversibly modifies the visual characteristic to the other different state, for instance, an opaque or non-transparent state.

In another embodiment, the initial state of the display 34 corresponding to a full container may be opaque or non-transparent, and the final state of the display 34 corresponding to an empty container may be transparent. The intermediate state(s), as illustrated in FIG. 2, corresponding to a partially full container, may be partially transparent.

In the embodiment of FIGS. 1-3, the display 34 is carried by a container sidewall, more specifically, the sidewalls of the container shoulder 18 and neck 20, and the sensor 32 is carried by a base wall of the container 12, more specifically, the wall of the container base 15. In other embodiments, for example those discussed below, the display 34 may be carried by a sidewall of the body 16 the container base wall, and the sensor 32 may be carried by a sidewall of the container 12, or the closure 13.

Figure 4:
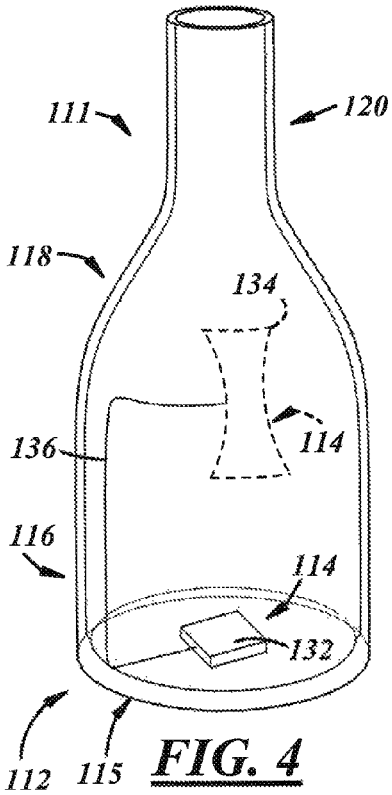
FIG. 4 is a perspective view of a product in accordance with an illustrative embodiment of the present disclosure and including a container that is empty, and a use indicator carried by the container and shown in an inactivated state.
Figure 5:
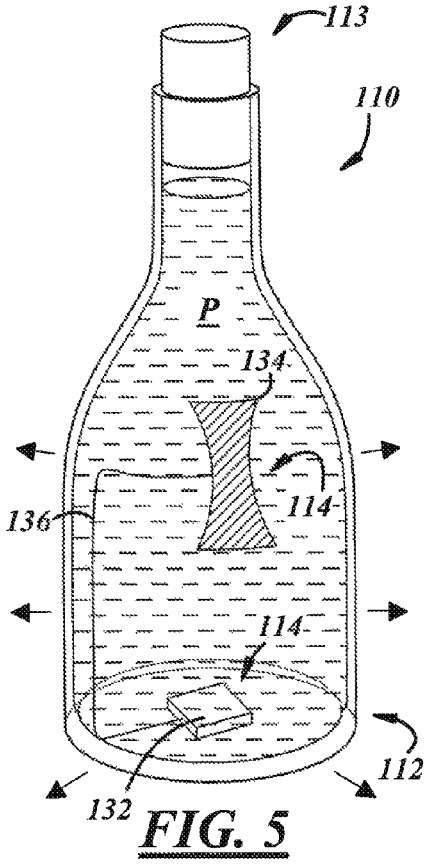
FIG. 5 is a perspective view of a package in accordance with an illustrative embodiment of the present disclosure and including the product of FIG. 4, with the container filled with product and enclosed by a closure, and with the use indicator shown in an activated state responsive to pressure within the closed package.
Figure 6:
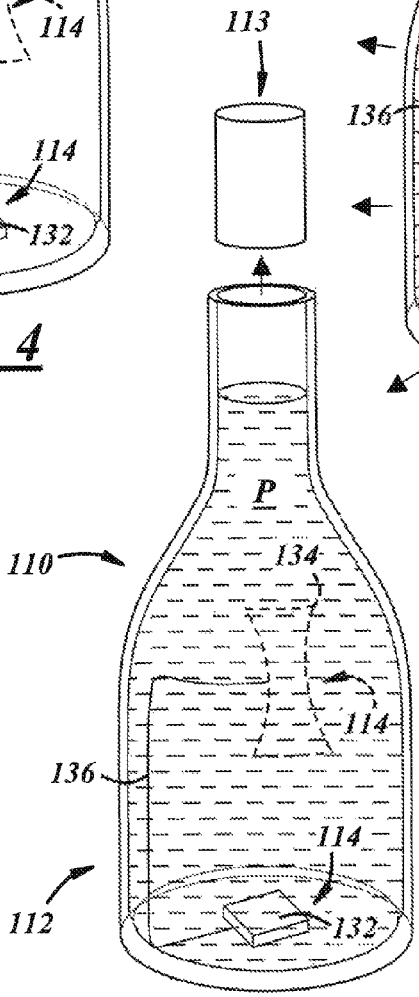
FIG. 6 is an exploded perspective view of the package of FIG. 5, wherein the use indicator is shown in a deactivated state responsive to depressurization of the package upon or after opening of the package.

FIGS. 4-6 illustrate another illustrative embodiment of a product 111 (FIG. 4) and a package 110 (FIGS. 5-6). This embodiment is similar in many respects to the embodiment of FIGS. 1-3 and like numerals between the embodiments generally designate like or corresponding elements throughout the several views of the drawing figures. Accordingly, the descriptions of the embodiments are incorporated into one another. Additionally, the description of the common subject matter generally may not be repeated here.

With reference to FIG. 4, a product 111 includes a container 12 and an indicator 114 carried by the container 112. The container 112 may include a base 115, a body 116 extending from the base 115, a shoulder 118 extending from the body 116, and a neck 120 extending from the shoulder 118. The indicator 114 may include a sensor 132 coupled to a wall of the base 115, a conductor 136 carried in walls of the base 115 and the body 116, and a display 134 coupled to the walls of the body 116 and the shoulder 118. As shown, the display 134 may be in the form of a product logo, but may be of any other suitable shape, size, and/or configuration. Prior to filling of the container 112, the display 134 may be in a default state. For example, the container 112 may be empty and the display 134 may be transparent.

With reference to FIG. 5, however, product P may be introduced into the container 112, the container 112 may be pressurized, and a closure 113 may be coupled to the container 112. Accordingly, the interior of the package 110 may be pressurized. In this embodiment, the sensor 132 may detect the weight of the product P and/or the pressure in the package 110 via forces or mechanical stresses in the container, for instance, in the container wall(s). In response, the sensor 132 outputs a voltage to the display 134 to modify the transparency or opacity of the display 134 to become opaque. As illustrated in FIG. 5, the display 134 is shown in an activated state, which, in the illustrated example embodiment is opaque.

But, with reference to FIG. 6, upon initial opening of the package 110 by partial or complete removal of the closure 113, the indicator 114 is adapted irreversibly to modify a state of a characteristic of the indicator 114 that is visible from outside of the container 112 to advise a user that the original package 110 has been opened. Accordingly, the indicator 114 will exhibit a second state of the visual characteristic that is different from the first state of the visual characteristic. For example, the display 134 of the indicator 114 is illustrated in FIG. 6 in a state different from that shown in FIG. 5. More specifically, the display 134 is shown in a deactivated state, which corresponds to an opened state of the container 112. In particular, the display 134 may exhibit modified or different opacity or transparency as a result of the package opening. Package opening results in a loss in pressure in the container and a concomitant reduced force on the container 112 and change in stress in the container wall(s). Accordingly, the sensor 132 outputs a different voltage level to the display 134, which, in turn, irreversibly modifies the visual characteristic to the different state, for instance, the transparent state.

In another embodiment, the default or inactivated state of the display 134 corresponding to an empty container before packaging may be opaque, the activated state of the package may be transparent, and the deactivated state corresponding to an opened package may be opaque.

Figure 7:
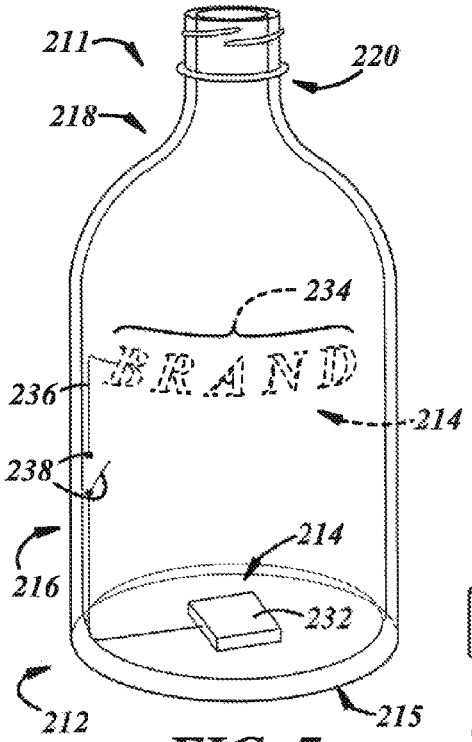
FIG. 7 is a perspective view of a product in accordance with an illustrative embodiment of the present disclosure and including a container that is empty, and a use indicator carried by the container and shown in an inactivated state.
Figure 8:
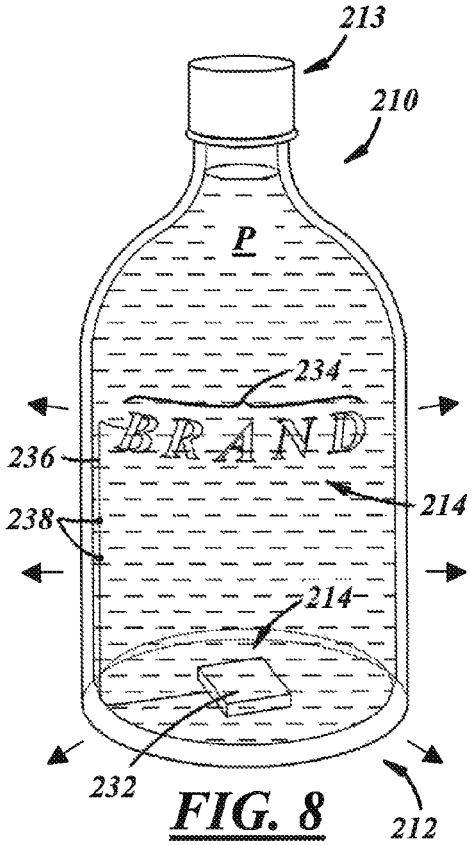
FIG. 8 is a perspective view of a package in accordance with an illustrative embodiment of the present disclosure and including the product of FIG. 7, with the container filled with product and enclosed by a closure, and with the use indicator shown in an activated state responsive to pressure within the dosed package.
Figure 9:
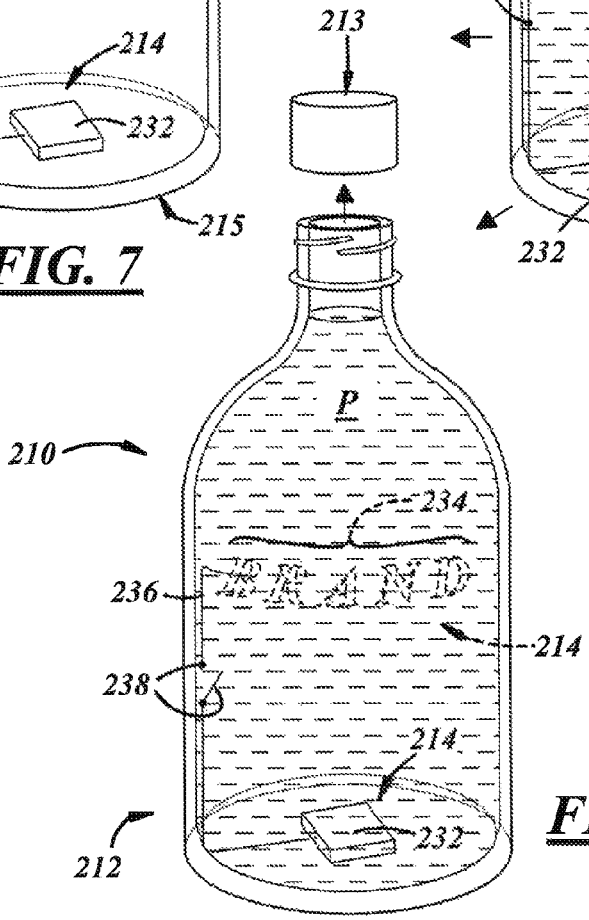
FIG. 9 is an exploded perspective view of the package of FIG. 8, wherein the use indicator is shown in a deactivated state responsive to depressurization of the package upon or after opening of the package.

FIGS. 7-9 illustrate another illustrative embodiment of a product 211 (FIG. 7) and package 210 (FIGS. 8-9). This embodiment is similar in many respects to the embodiment of FIGS. 1-6 and like numerals between the embodiments generally designate, like or corresponding elements throughout the several views of the drawing figures. Accordingly, the descriptions of the embodiments are incorporated into one another. Additionally, the description of the common subject matter generally may not be repeated here.

With reference to FIG. 7, the product 211 includes a container 212 and an indicator 214 carried by the container 212. The container 212 may include a base 215, a body 216 extending from the base 215, a shoulder 218 extending from the body 216, and a neck 220 extending from the shoulder 218. The indicator 214 may include a sensor 232 coupled to wall of the base 215, a conductor 236 carried in walls of the base 215 and the body 216, and a display 234 coupled to the wall of the body 216. As shown, the display 234 may be in the form of indicia, like a product brand name, logo, slogan, or the like, but may be of any other suitable shape, size, and/or configuration.

The indicator 214 also may include a switch 238 in communication between the sensor 232 and the display 234, for instance, in line with the conductor 236. In one embodiment, the switch 238 may function as a close-once-only d/or open-once-only type of switch and may include, for example, an electronic latch. For instance, the switch 238 may be configured to be closed once during filling and pressurization of the package 210 at the product packagers facility, and then opened once a user opens the package 210 there it remains in its open state and cannot be closed again even if the package is refilled and depressurized. The switch 238 is illustrated schematically and, as used herein, the term switch includes any suitable switch(es), semiconductor(s), circuit(s), or the like. Prior to filling of the container 212, the display 234 may be in a default state. For example, the container 212 may be empty and the display 234 may be transparent.

With reference to FIG. 8, however, product P may be introduced into the container 212, the container 212 may be pressurized, and a closure 213 may be coupled to the container 212. Accordingly, the interior of the package 210 may be affirmatively pressurized in any suitable manner before and during closing of the container 212 with the closure 213. Such pressurization may be instead of or in addition to passive pressurization created by the product P itself. In this embodiment, the sensor 232 may detect the weight of the product P and/or the pressure in the package 210 via forces or mechanical stresses in the container, for instance, in the container wall(s). In response, the sensor 232 outputs a voltage to the display 234 to modify the transparency or opacity of the display 234 to become opaque. As illustrated FIG. 8, the display 234 is shown in an activated state, which, in the illustrated example embodiment is opaque.

But, with reference to FIG. 9, upon initial opening of the package 210 by partial or complete removal of the closure 213, the indicator 214 is adapted irreversibly to modify a state of a characteristic of the indicator 214 that is visible from outside of the container 212 to advise a user that the original package 210 has been opened. Package opening results in a loss in pressure in the container 212 and a concomitant reduced force on the container 212 and change in stress in the container wall. Accordingly, the sensor 232 outputs a different voltage level, which causes the switch 238 to permanently open or fail. In turn, the now permanently opened or failed switch 238 cuts off voltage to the display 234, thereby irreversibly modifying the visual characteristic to the different state, for instance, the transparent state.

Figure 10:
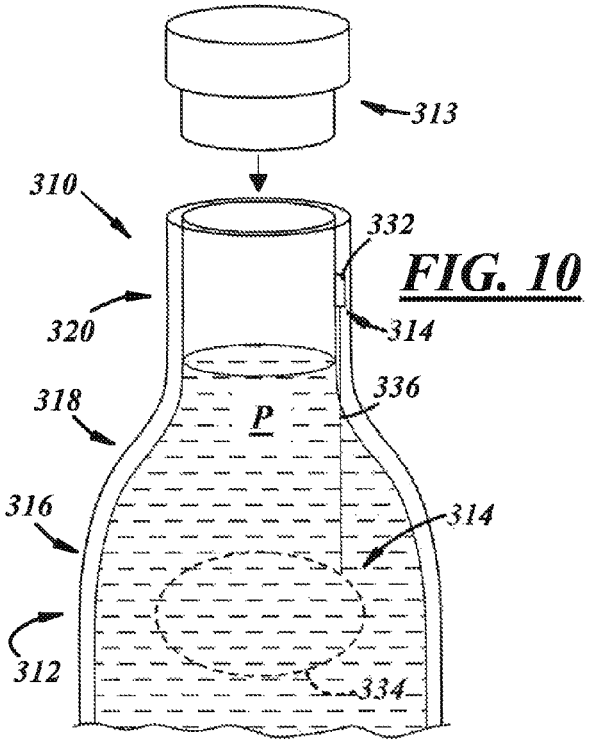
FIG. 10 is an exploded fragmentary perspective view of a package in accordance with illustrative embodiment of the present disclosure and including a container that is filled with a product, a closure, and a use indicator carried by the container and shown in an inactivated state.
Figure 11:
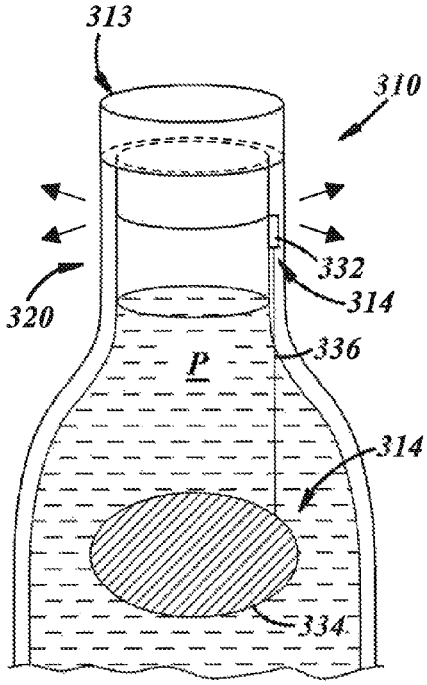
FIG. 11 is a fragmentary perspective view of the package of FIG. 10, including the filled container enclosed by the closure, and with the use indicator shown in an activated state responsive to pressure imposed on the container by the closure.
Figure 12:
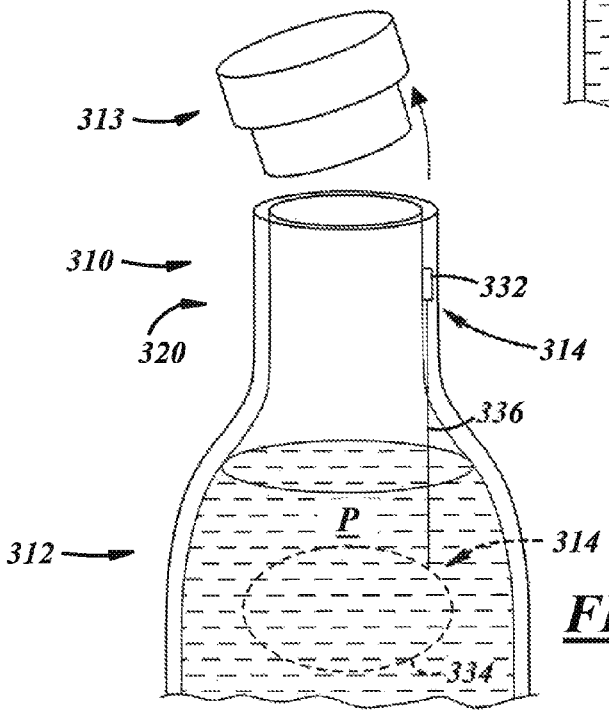
FIG. 12 is a fragmentary exploded perspective view of the package of FIG. 10, illustrating the closure removed from the container, and with the use indicator shown in a deactivated state responsive to opening of the package.

FIGS. 10-12 illustrate another illustrative embodiment of a package 310. This embodiment is similar in many respects to the embodiment of FIGS. 1-9 and like numerals between the embodiments generally designate like or corresponding elements throughout the several views of the drawing figures. Accordingly, the descriptions of the embodiments are incorporated into one another. Additionally, the description of the common subject matter generally may not be repeated here.

With reference to FIG. 10, the package 310 includes a container 312, an indicator 314 carried by the container 312, and a closure 313 coupled to the container 312. The container 312 may include a body 316, a shoulder 318 extending from the body 316, and a neck 320 extending from the shoulder 318. The indicator 314 may include a sensor 332 coupled to a wall of the neck 320, a conductor 336 carried in walls of the neck 320, shoulder 318, and body 316, and a display 334 coupled to the wall of the body 316 and/or shoulder 318. The sensor 332 may include a pressure sensor that may sense pressure imposed on the container 312 by the closure 313, or may include a proximity sensor, switch, or any other suitable device(s), that may cooperate with a corresponding portion of the closure 313. In one embodiment, the sensor 332 may include an RFID sensor that may cooperate with an RFID tag on the closure, or vice-versa.

Prior to filling of the container 312 and coupling of the closure 313 thereto, the display 334 may be in a default state. For example, the display 334 may be transparent.

With reference to FIG. 11, however, the closure 313 may be coupled to the container 312. In one embodiment, the sensor 332 may detect the pressure imposed on the container neck 320 by the closure 313 being inserted therein, via forces or mechanical stresses in the container. In another embodiment, the sensor 332 may detect presence of the closure 313 coupled to the container neck 320. In response, the sensor 332 outputs a voltage to the display 334 to modify the transparency or opacity of the display 334 to become opaque. As illustrated in FIG. 11, the display 334 is shown in an activated state, which, in the illustrated example embodiment is opaque.

But, with reference to FIG. 12, upon initial opening of the package 310 by partial or complete removal of the closure 313 from the container 312, the indicator 314 is adapted irreversibly to modify state of a characteristic of the indicator 314 that is visible from outside of the container 312 to advise a user that the original package 310 has been opened. Package opening results in a reduction in pressure in the container neck 320 and a concomitant reduced force on the container 312 and change in stress in the container wall. Accordingly, the sensor 332 outputs a different voltage level to the display 334, which, in turn, irreversibly modifies the visual characteristic to the different state, for instance, the transparent state. The sensor 332 is configured to be activated only once.

Figure 13:
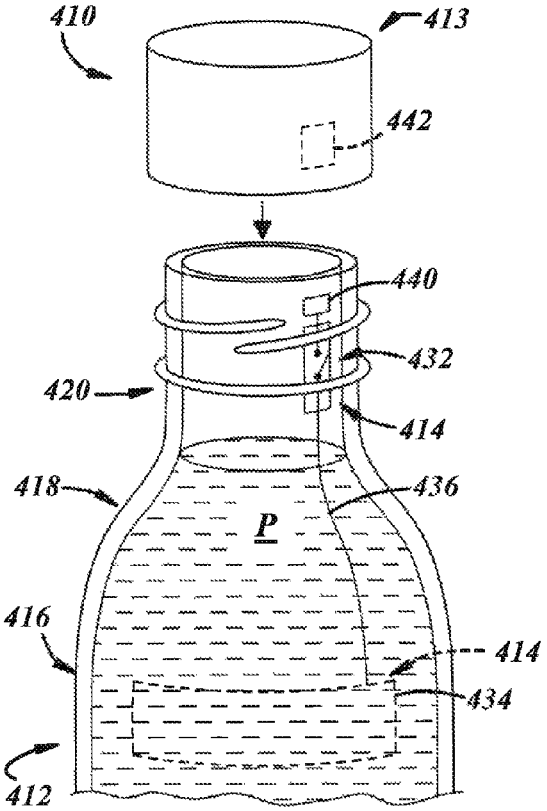
FIG. 13 is a fragmentary exploded perspective view of a package in accordance with an illustrative embodiment of the present disclosure and including a container that is filled with a product, a closure, and a use indicator carried by the container and shown in an inactivated state.
Figure 14:
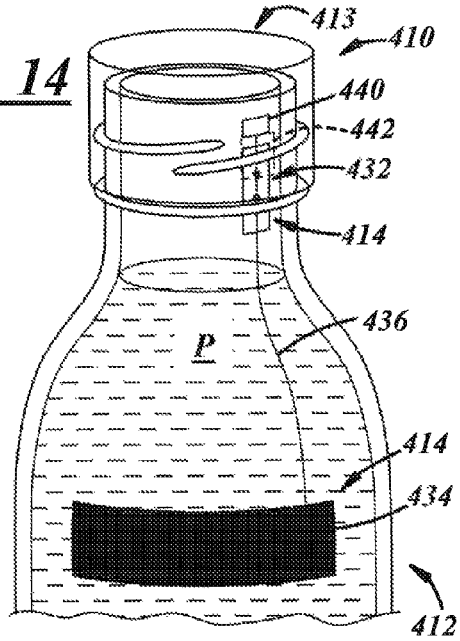
FIG. 14 is a fragmentary perspective view of the package of FIG. 13, illustrating the closure coupled to the container and the use indicator shown in the activated state responsive to the coupling of the closure to the container.
Figure 15:
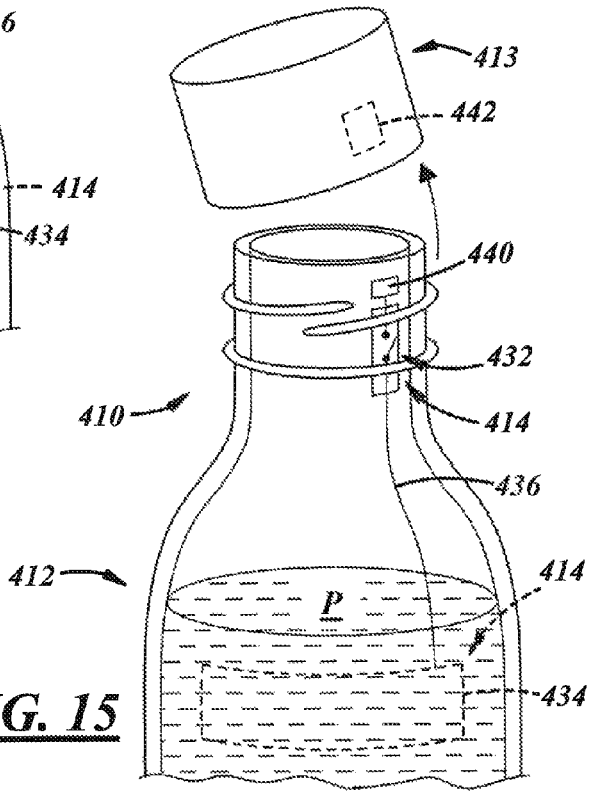
FIG. 15 is a fragmentary exploded perspective view of the package of FIG. 13, illustrating the closure removed from the container, and with the use indicator shown in a deactivated state responsive to opening of the package, for example, via removal of the closure from the container.

FIGS. 13-15 illustrate another illustrative embodiment of a package 410. This embodiment is similar in many respects to the embodiment of FIGS. 1-12 and like numerals between the embodiments generally designate like or corresponding elements throughout the several views of the drawing figures. Accordingly, the descriptions of the embodiments are incorporated into one another. Additionally, the description of the common subject matter generally may not be repeated here.

With reference to FIG. 13, the package 410 includes a container 412, an indicator 414 carried by the container 412, and a closure 413 for coupling to the container 412. The container 412 may include a body 416, a shoulder 418 extending from the body 416, and a neck 420 extending from the shoulder 418. The indicator 414 may include a sensor 432 coupled to a wall of the neck 420, a conductor 436 carried in walls of the neck 420, shoulder 418, and body 416, and a display 434 coupled to the wall of the body 416. The indicator 414 also may include a power source 440, for instance, one or more batteries, quartz piezoelectrics, capacitors, solar cells, or any other suitable supply of electricity. The closure 413 may include a switch activator 442, for instance, a magnet, a ferrous metal, or any other suitable switch activation component. The sensor 432 may include a switch, for instance, a reed switch, or any other suitable device(s), that may cooperate with the switch activator 442.

Prior to filling of the container 412 and coupling of the closure 413 thereto, the display 434 may be in a default state. For example, the display 434 may be transparent.

With reference to FIG. 14, however, the closure 413 may be coupled to the container 412 and the switch activator 442 may be located next to the switch 432 thereby causing the switch 432 to dose and complete a circuit from the power source 440 to the display 434. The voltage from the power source 440 to the display 434 modifies the transparency or opacity of the display 434. As illustrated in FIG. 14, the display 434 is shown in an activated state, which, in the illustrated example embodiment is opaque, for example, for brand reinforcement But, with reference to FIG. 15, upon initial opening of the package 410 by partial or complete removal of the closure 413 from the container 412, the indicator 414 is adapted irreversibly to modify a state of a characteristic of the indicator 414 that is visible from outside of the container 412 to advise a user that the original package 410 has been opened. Package opening results permanent opening of the switch 432 and a concomitant cutoff of voltage from the power source 440 to the display 434. Accordingly, the display 434 reverts irreversibly to its default or deactivated state, for a concomitant irreversible modification of the visual characteristic to the different state, for instance, the transparent state. The switch 432 may be a latch, or the like.

Figures 16, 17:
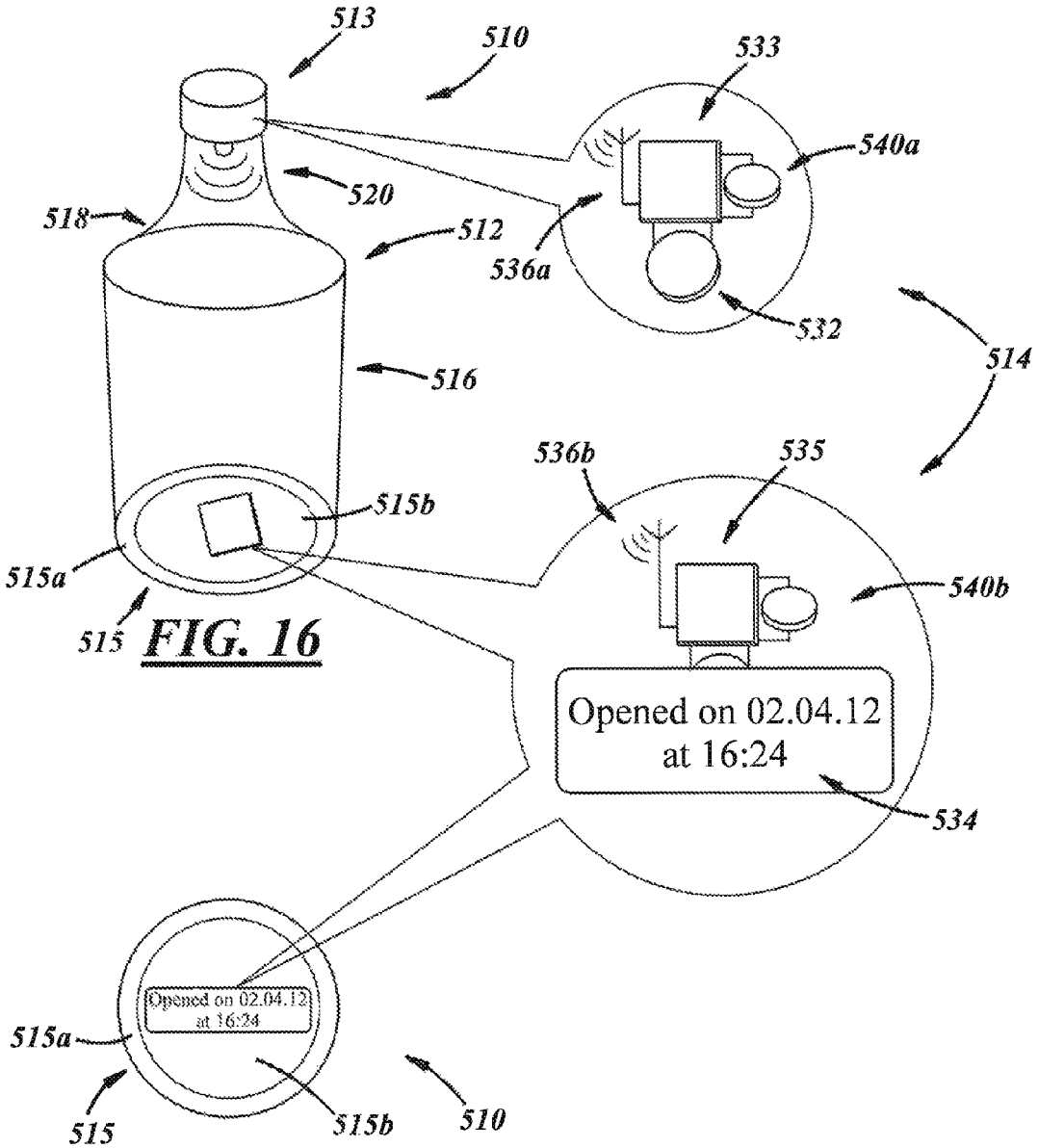
FIG. 16 is a perspective view of a package in accordance with a further illustrative embodiment of the present disclosure and including a container that is filled with a flowable product, a closure coupled to the container, and a use indicator carried by the package.
FIG. 17 is a bottom view of the container of FIG. 16, illustrating a display and a microcontroller coupled to one another and carried by a punt of the container.

FIGS. 16-17 illustrate another illustrative embodiment of a package. This embodiment is similar in many respects to the embodiment of FIGS. 1-15 and like numerals between the embodiments generally designate like or corresponding elements throughout the several views of the drawing figures. Accordingly, the descriptions of the embodiments are incorporated into one another. Additionally, the description of the common subject matter generally may not be repeated here.

With reference to FIG. 16, the package 510 includes a container 512, an indicator 514, at least a portion of which is carried by the container 512, and a closure 513 for coupling to the container 512. The container 512 may include a base 515, a body 516 extending from the base 515, a shoulder 518 extending from the body 516, and a neck 520 extending from the shoulder 518. The base 515 may include a bottom **515*a*, which may include an annular surface, and a push-up or punt 515*b* extending radially and axially away from the bottom 515*a***.

The indicator 514 may include a sensor 532 that may be carried by the closure 513, for example, coupled to a base wall thereof, or in any other suitable manner. The indicator 514 also may include a first microcontroller 533, which may be electrically coupled to the sensor 532, and may include a radio frequency (RF) microcontroller with a first antenna **536*a*. The microcontroller 533, and the antenna 536*a*, may be carried by the closure 513, for example, coupled to a base wall thereof, or in any other suitable manner. The sensor 532 may include a piezoelectric sensor, or any other suitable sensor to measure pressure in the package 510, for example, after the container 512 has been filled with a product and the closure 513 sealingly coupled thereto to form the package 510**.

The indicator 514 further may include a display 534 that may be carried by the container 512, for example, coupled to a wall of the base 515 of the container 512. The indicator 514 also may include a second microcontroller 535, which may be electrically coupled to the display 534, and may include an RF microcontroller with a second antenna **536*b*. The microcontroller 535, and the antenna 536*b*, may be carried by the container 512, for example, coupled to the base 515, or in any other suitable manner. More specifically, the display 534 and the microcontroller 535 may be carried externally of the container 512, for instance, in the punt 515*b* of the container 512. The display 534 and microcontroller 535 may be protected from tampering, for example, by applying a non-conductive resin thereover and in contact with the container 512** to completely cover the components.

The microcontrollers 533, 535 may include one or more processors, memory, input/output interfaces, clock, and the like, and, for example, may include a CC430 microcontroller available from Texas Instruments of Dallas, Tex. The microcontrollers 533, 535 may process data and execute instructions that provide at least some of the functionality for the indicator 514. As used herein, the term instructions may include, for example, control logic, computer software and/or firmware, programmable instructions, or other suitable instructions. The microcontrollers 533, 555 may be RF enabled, and/or may be wired together, or may be integrated as a single microcontroller.

The indicator 514 also may include one or more power sources. In a first example, the indicator 514 may include a first power source 540*a* electrically coupled to the first microcontroller 533 and/or the pressure sensor 532 in any suitable manner. In a second example, the indicator 514 may include a second power source 540*b* electrically coupled to the second microcontroller 535 and/or the display 534 in any suitable manner. Each power source 540*a* 540*b* may include one or more batteries, quartz piezoelectrics, capacitors, solar cells, or any other suitable supply of electricity.

Upon initial opening of the package 510 by partial or complete removal of the closure 513 from the container 512, the indicator 514 is adapted irreversibly to modify a state of a characteristic of the indicator 514 that is visible from outside of the container 512 to advise a user that the original package 510 has been opened. Package opening results in a reduction in pressure in the package 510 and a concomitant reduced force on the pressure sensor 532. Accordingly, the sensor 532 outputs a different voltage level to the first RF microcontroller 533, which, in turn, may use the first antenna 536*a* to communicate a corresponding signal wirelessly to the second RF microcontroller 535. In turn, the second RF microcontroller 535 may use the second antenna 536*b* to receive the signal and then may process the received signal to generate an output signal for communication to the display 534 to modify the visual characteristic to the different state, for instance, display of a date and/or time that the closure was opened. The second RF microcontroller and/or the display 534 is/are configured to be activated only once so that the date and/or time of opening of the package is irreversibly displayed.

According to other embodiments of the present disclosure, there are provided one or more methods of producing and using a package. The method of producing a package includes coupling at least part of an indicator to a container, wherein the indicator includes a sensor and a display, filling the container with an original flowable product, and closing the container with a closure. The closing step may include pressurizing the package in any suitable manner before and during application of the closure to the container. After one or both of the filling or closing steps, the display exhibits an initial state of a visual characteristic of a plurality of states of the visual characteristic. The method of using that product includes initially opening the package, and also may include dispensing at least some of the original flowable product. Responsive to at least one of the opening or dispensing, the display exhibits another state of the visual characteristic different from and irreversible to the initial state of the visual characteristic.

There thus has been disclosed a container and a use indicator carried by the container and that fully satisfies all of the objects and aims previously set forth. The disclosure has been presented in conjunction with several illustrative embodiments, and additional modifications and variations have been discussed. Other modifications and variations readily will suggest themselves to persons of ordinary skill in the art in view of the foregoing discussion. The disclosure is intended to embrace all such modifications and variations as fall within the spirit and broad scope of the appended claims.

What is claimed is:

1. A package that includes:

a container having an open end;

a closure closing the open end of the container; and a sensor carried by at least one of the container or the closure to detect at least one of pressure in the container or weight of product in the container, wherein said sensor is responsive to a change associated with at least one of pressure in the container, weight of product in the container, or the closure relative to the container, to modify an optical characteristic associated with the package to indicate that the package has been opened and/or that product has been dispensed from the container, and wherein a portion of the package exhibits an initial state of the optical characteristic, and then exhibits another state irreversible to the initial state after the package has been opened and/or relieved of at least some of the product in the container.

2. The package set forth in claim 1 and that includes a display electrically coupled to the sensor and carried by the container to exhibit the optical characteristic.

3. The package set forth in claim 2 wherein said display is carried by a sidewall of said container, and said sensor is carried by a base wall of said container.

4. The package set forth in claim 2 wherein said display is carried by a base wall of said container, and said sensor is carried by said closure.

5. The package set forth in claim 1 wherein the other state includes at least one of a date or time that the package was been opened.

6. A product that includes:

a container; and an indicator carried by the container, and responsive to a change in at least one state of the container to irreversibly modify a visual characteristic visible from outside the container.

7. The product set forth in claim 6 wherein the indicator displays an initial state of the visual characteristic, and then displays another state irreversible to the initial state after the container has been opened.

8. The product set forth in claim 6 wherein the indicator includes:

a sensor carried by the container to detect one or more forces acting on the container; and a display carried by the container and electrically coupled to the sensor.

9. The product set forth in claim 6 wherein the sensor is a piezoelectric sensor in the container to detect stress in the container, and the display is an electrochromic device.

10. The product set forth in claim 6 wherein the visual characteristic is transparency of at least a portion of the product.

11. The product set forth in claim 6 wherein the visual characteristic is at least one of a date or time display.

12. The product set forth in claim 6 wherein the indicator includes:

a piezoelectric sensor carried by the container; and an electrochromic device carried by the container and electrically coupled to the sensor.

13. The product set forth in claim 12 wherein the indicator also includes a conductor carried by the container and electrically coupling the sensor and the electrochromic device together.

14. The product set forth in claim 13 wherein the container is a bottle including a base, a body extending from the base, a shoulder extending from the body, and a neck extending from the shoulder, and wherein the sensor is carried at a base of the bottle, and the electrochromic device is carried at the neck or the body of the bottle, and the conductor is carried along the base and the body of the bottle.

15. The product set forth in claim 13 wherein the indicator further includes a switch in communication between the sensor and the electrochromic device that opens upon a change in pressure in the container.

16. The product set forth in claim 6 wherein the indicator includes an electrochromic device configured in the form of indicia.

17. A package that includes:

the product set forth in claim 6;

an original flowable product dispensably disposed within the container; and a closure coupled to the container.

18. The package set forth in claim 17 wherein the indicator is responsive to at least one of a change in pressure in the container or a change in weight of the original flowable product in the container as a result of dispensing of the product from the container.

19. The package set forth in claim 17 wherein the indicator is responsive to a change associated with the closure relative to the container.

20. The package set forth in claim 19 wherein the container is a bottle including a base, a body extending from the base, a shoulder extending from the body, and a neck extending from the shoulder, and the indicator includes:

a sensor carried by a wall of the bottle at the bottle neck; and an electrochromic device carried by the wall of the bottle at the bottle neck or the bottle body, and electrically coupled to the sensor;

wherein the sensor is responsive to a change in force imposed on the wall by the closure in the bottle.

21. The package set forth in claim 19 wherein the closure includes a magnet, the indicator includes a switch carried at the neck of the container and responsive to removal of the closure from the container.

22. The package set forth in claim 17 wherein the visual characteristic has an initial state when the container is filled with the original flowable product, and at least one other state irreversible to the initial state.

23. The package set forth in claim 22 wherein the visible characteristic states are part of a continuum of visible characteristic states.

24. The package set forth in claim 17 wherein the indicator is responsive to modify a state of the visual characteristic when at least some of the original flowable product has been dispensed from the container and/or when the closure has been removed from the container.

25. The package set forth in claim 17 wherein the closure carries a pressure sensor and a first microcontroller electrically coupled to the pressure sensor, and wherein the indicator includes a second microcontroller carried by the container and in communication with the first microcontroller, and a display carried by the container and electrically coupled to the second microcontroller.

26. The package set forth in claim 25 wherein container includes a base having a punt, and the second microcontroller and the display are carried in the punt.

27. The package set forth in claim 25 wherein the pressure sensor is responsive to opening of the package, and the display includes a liquid crystal display to display at least one of date or time of the package opening.

28. The product of claim 6, wherein at least a portion of the indicator is non-removably secured to the container.

29. A method of producing a package that includes:

(a) coupling at least a portion of an indicator to a container, wherein the indicator includes a sensor and a display that exhibits a visual characteristic;

(b) filling the container with an original flowable product; and (c) closing the container with a closure, wherein, after at least one of the filling or closing steps, the display exhibits an initial state of the visual characteristic of a plurality of states of the visual characteristic and the sensor and the display are configured such that the display will exhibit an other state of the visual characteristic different from and irreversible to the initial state, responsive to at least one of opening of the package or dispensing of the product from the container.

30. A package produced by the method of claim 29.

31. The method of claim 29, wherein the initial state is a transparent state or an opaque state corresponding to a full state of the container, and the other state is the opposite of the initial state corresponding to an empty state of the container.

32. The method of claim 31, wherein the plurality of states also includes at least one intermediate state corresponding to a partially full container.

33. The method of claim 29, wherein the coupling step includes non-removably coupling the display to the container.

* * * * *